US005485769A

United States Patent [19]

Olson et al.

[11] Patent Number: 5,485,769

[45] Date of Patent: Jan. 23, 1996

[54] SQUARE DRIVE ADAPTER

[75] Inventors: Gene E. Olson, Kenosha; Gerald A. Wridt, Racine, both of Wis.

[73] Assignee: Snap-on Incorporated, Kenosha, Wis.

[21] Appl. No.: 285,093

[22] Filed: Aug. 3, 1994

Related U.S. Application Data

[63] Continuation-in-part of Ser. No. 36,321, Mar. 24, 1993, Pat. No. 5,343,786.

[51] Int. Cl.[6] ..... B25B 23/16

[52] U.S. Cl. ..... 81/177.85; 81/438

[58] Field of Search ..... 81/437, 438, 439, 81/121.1, 177.85, 177.1, 177.2, DIG. 11; 279/9.1, 89, 95

[56] References Cited

U.S. PATENT DOCUMENTS

| | | | |
|---|---|---|---|
| 2,288,584 | 6/1942 | Longfellow . | |
| 2,519,559 | 8/1950 | Foster et al. . | |
| 4,367,663 | 1/1983 | Merics | 81/177.2 |
| 4,399,723 | 8/1983 | Marleau | 81/437 |
| 4,754,670 | 7/1988 | Raymond | 81/177.85 X |
| 4,982,632 | 1/1991 | Baremore . | |
| 5,168,782 | 12/1992 | Cromwell | 81/177.85 X |

OTHER PUBLICATIONS

Snap–on Tools 1992 Catalog, p. 179, Ratchet and Bit Set.

*Primary Examiner*—D. S. Meislin
*Attorney, Agent, or Firm*—Emrich & Dithmar

[57] ABSTRACT

A tool combination includes a socket with a hole extending axially therethrough having a large square drive portion and a small drive portion and at least one shoulder between said large and small drive portions. In one embodiment the small drive portion of the hole is hexagonal in shape and a hexagonal bit has an application end and a coupling end, the application end being insertable into the hole from the large drive portion thereof. The coupling end is provided with a retainer in the form of either an enlarged head or a laterally projecting ear which seats against the shoulder, with the application end of the bit projecting forwardly from the bit end of the socket. In a second embodiment the tool combination is a drive adapter, the small drive portion of the hole being square in shape. A square drive lug is insertable in the small drive portion of the hole from the large drive portion thereof and has upset crimped corners forming projection ears to seat against the shoulder. A male drive element, when received in the large drive portion of the hole, retains the bit or drive lug in place.

12 Claims, 2 Drawing Sheets

Fig. 8
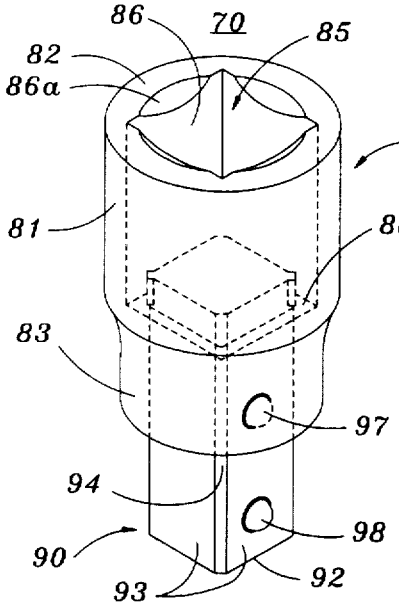
Fig. 13
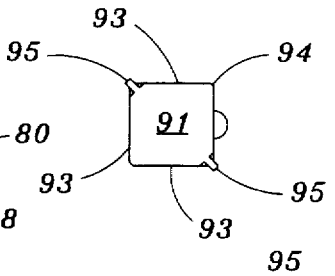
Fig. 9
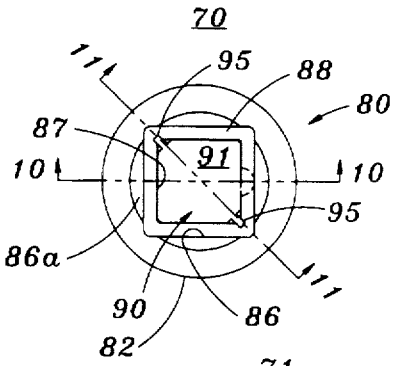
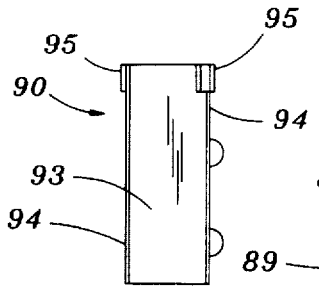
Fig. 14
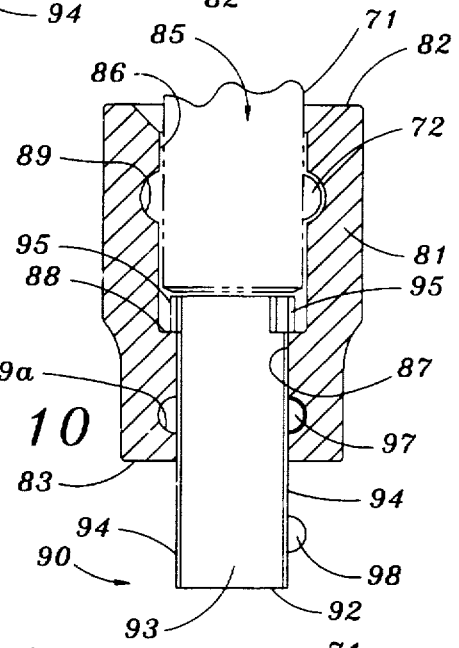
Fig. 10
Fig. 12
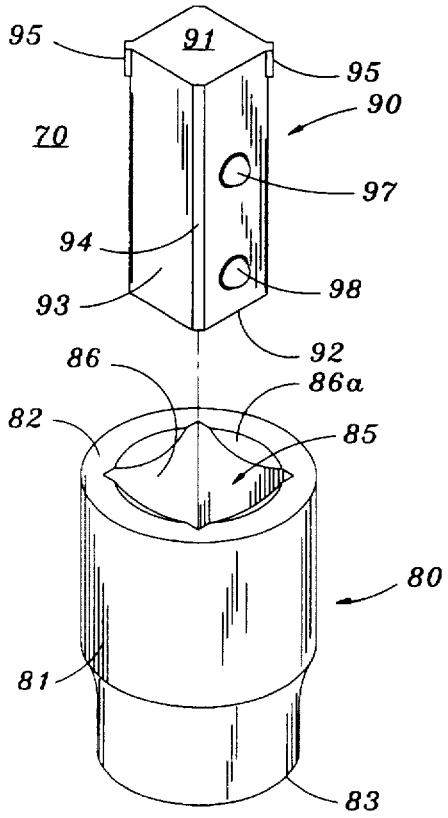
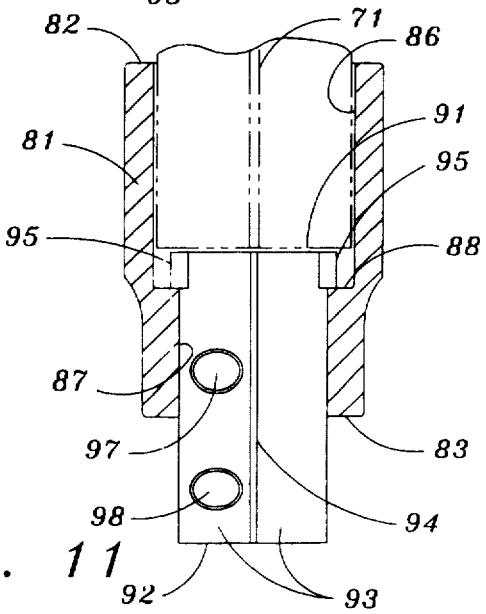
Fig. 11

SQUARE DRIVE ADAPTER

CROSS-REFERENCE TO RELATED APPLICATION

This is a continuation-in-part of U.S. application Ser. No. 036,321, filed Mar. 24, 1993, now U.S. Pat. No. 5,343,786.

BACKGROUND OF THE INVENTION

1. Field of the Invention

The present invention relates to socket wrench sets and, in particular, to sockets adapted for use with any of a plurality of different-sized driven members. The invention has particular application to drive adapters for converting from one size of polygonal drive to another.

2. Description of the Prior Art

Socket wrench sets are typically provided with one or more square drive wrenches, each having a square drive lug adapted to be coupled to a variety of different-sized sockets. A typical wrench set may include a plurality of different wrenches with different-sized square drive lugs, each of which can mate with a plurality of different sockets. For the purpose of converting from one size of drive to another, drive adapters are provided. A drive adapter has a square drive socket at one end of a first size and a square drive lug at the other end of a second size, the socket being adapted for mating engagement with an associated male square drive element, as on a wrench tool, while the drive lug is adapted for mating engagement with an associated female element, such as an associated socket tool.

Such prior adapters are of one-piece construction and are characterized by a rather abrupt change in cross-section where the drive lug joins the remainder of the adapter body. The drive lug is subject to breakage from the socket at this transition when very high torque is applied. While it is possible to make the adapter of a material, or subject it to a heat treatment, to increase its strength so that it would resist breakage, this material or treatment would have to be applied to the entire adapter, even though it would not be necessary for the socket portion, thereby significantly increasing the cost of the adapter.

It is known to provide socket wrench sets wherein at least one of the sockets is a bit socket, i.e., a socket which is adapted to receive any of a number of different-sized bits. Such bits may be of any of a number of different types, such as screwdriver bits, wrench bits and other types of drive configurations. Typically, each such bit has a polygonal shank provided at an application end with a drive configuration adapted for a particular drive application. The shank is dimensioned to fit into the workpiece-engaging end of a wrenching socket, being retained in place therein by a set screw or roll pin or the like, received through radial bores in the socket, or by a friction ring, such as a wire ring or O-ring. For example, the socket may have a hexagonal workpiece engaging end, in which case each of the bits will have a hexagonal shaft mateably engageable in the socket. The socket also has a drive recess at a drive end thereof, which may be a square recess adapted to receive a drive lug of an associated driving tool, such as a ratchet wrench or the like. In this way, a single socket may be used with a driving tool to drive a plurality of different bits.

However, in this prior arrangement, in the event a set screw or roll pin is used for bit retention, engagement and disengagement of the bits in the socket is relatively cumbersome and time consuming, requiring the mounting and demounting of the set screw or roll pin, each time the bit is changed. Indeed, it is so cumbersome that normally a user will purchase a separate socket for each bit to obviate bit changing. Furthermore, the set screw or roll pin constitutes an additional part which must be manufactured, inventoried, and kept track of, which adds to the cost of manufacture and assembly, and further entails the risk of loss by the user. The use of a friction ring for bit retention simplifies bit changing but does not provide a very secure retention.

It is also known to provide a bit set for use with a box ratchet wrench, each of the bits having a shank which is insertable into the box ratchet, and the depth of insertion being limited by a lateral projection on the bit shank approximately midway along its length. Such ratchet and bit sets are sold, for example, by Snap-on Tools Corporation under the designation CRA180PB. Typically, the box ratchet is provided with an O-ring or the like to frictionally hold the bit in place in the ratchet.

SUMMARY OF THE INVENTION

It is a general object of the invention to provide an improved polygonal drive adapter which avoids the disadvantages of prior adapters while affording additional structural and operating advantages.

An important feature of the invention is the provision of a drive adapter which is of simple and economical construction, and yet which can be made of sufficient strength to resist breakage of the drive lug portion of the adapter from the socket portion.

In connection with the foregoing feature, a further feature of the invention is the provision of a drive adapter of the type set forth, which is of economical construction such as to reduce cost of replacement in the event of breakage.

A further feature of the invention is the provision of a drive adapter which is of two-part construction, including a socket portion separable from a drive lug portion.

In connection with the foregoing feature, a further feature of the invention is the provision of a drive adapter of the type set forth, which is characterized by economy of manufacture and ease of use.

These and other features of the invention are attained by providing a polygonal drive adapter for transmitting torque between polygonal male and female drive elements of different size comprising: a unitary one-piece socket member having first and second ends and a longitudinal hole therethrough from end-to-end, the hole having a first polygonal portion of a first size adjacent to the first end for receiving an associated male polygonal drive element in mating engagement therewith and a second polygonal portion of a second size different from the first size adjacent to the second end, a shoulder in the hole between the first and second portions facing the first end, and an elongated polygonal drive lug having an application end receivable in the second portion of the hole in mating engagement therewith and adapted for mating engagement with an associated female drive element and a coupling end, the drive lug having a plurality of flat planar sides joined by a plurality of corner portions, the drive lug including laterally extending retaining projections at spaced-apart locations adjacent to the coupling end, the application end of the drive lug being insertable in and removable from the hole from the first end thereof with the projections engageable with the shoulder to limit the depth of insertion at a working position wherein the application end of the drive lug projects outwardly beyond the second end of the socket member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 8 is a perspective view of a polygonal drive adapter in accordance with the present invention;

FIG. 9 is a reduced, top plan view of the drive adapter of FIG. 8;

FIG. 10 is an enlarged view in vertical section taken along the line 10—10 in FIG. 9, and with the drive lug shown in elevation;

FIG. 11 is an enlarged view in vertical section taken along the line 11—11 in FIG. 9, with the drive lug shown in elevation;

FIG. 12 is an exploded perspective view of the drive adapter of FIG. 8;

FIG. 13 is a reduced, top plan view of the drive lug of the drive adapter of FIG. 12; and FIG. 14 is a front elevational view of the drive lug of FIG. 13.

DESCRIPTION OF THE PREFERRED EMBODIMENTS

Figure 1:
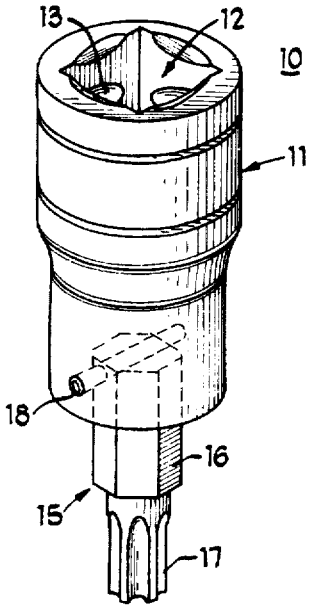
Fig 1 PRIOR ART
FIG. 1 is a perspective view of a prior art bit and socket combination.

Referring to FIG. 1, there is illustrated a prior tool combination or assembly 10 comprising a socket 11 and a bit 15. The socket 11 has a drive recess 12 which may be substantially square in transverse cross section for receiving a drive lug of an associated driving tool (not shown), such as a ratchet wrench. The drive recess 12 may be provided with detent recesses 13 for receiving a detent ball of the associated drive lug to retain the socket 11 in place on the driving tool in a known manner. The socket 11 is provided at its other end with a workpiece-engaging recess (not shown), which is typically polygonal in transverse cross section and is adapted to receive a correspondingly shaped bit in a known manner.

The bit 15 has a shank 16 which is shaped for mating engagement in the workpiece-engaging recess of the socket 11, both the shank and the recess being hexagonal in shape in the illustrated embodiment. The bit 15 is provided at its distal end with an application tip 17 shaped and dimensioned for a particular application. For example, the application tip 17 may be a screwdriver bit, a hexagonal key, or any of a number of other types of male drive configurations adapted to be received in complementary female recesses in members to be driven. A roll pin 18 extends diametrically through complementary aligned bores in the socket 11 and the bit shank 16, to fixedly secure the bit 15 in the socket 11. Alternatively, a set screw could be used.

It will be appreciated that any of a number of different bits may be thus mounted in the socket 11, each of these bits having the same size and shape shank 16, but having different sized and/or shaped application tips 17, so that a single socket can be used to drive a number of different bits. The socket 11 is similar to a standard configuration except for the presence of a diametrical bore in a thickened sidewall to accommodate the roll pin 18 or set screw. However, the use of the roll pin or set screw to mount and demount the bit 15 is a major inconvenience, to the point that users typically purchase a separate socket for each bit to obviate bit changing. It represents an extra part with all the attendant disadvantages in manufacturing, inventorying, storage and use. Furthermore, the roll pin or set screw 18 may work free in use or the roll pin may break, allowing the bit 15 to fall out of the socket 11. A friction ring (not shown) may be used in lieu of the roll pin or set screw 18 to retain the bit 15 in the socket 11. This simplifies bit interchange but does not provide a very secure retention of the bit.

Figure 5:
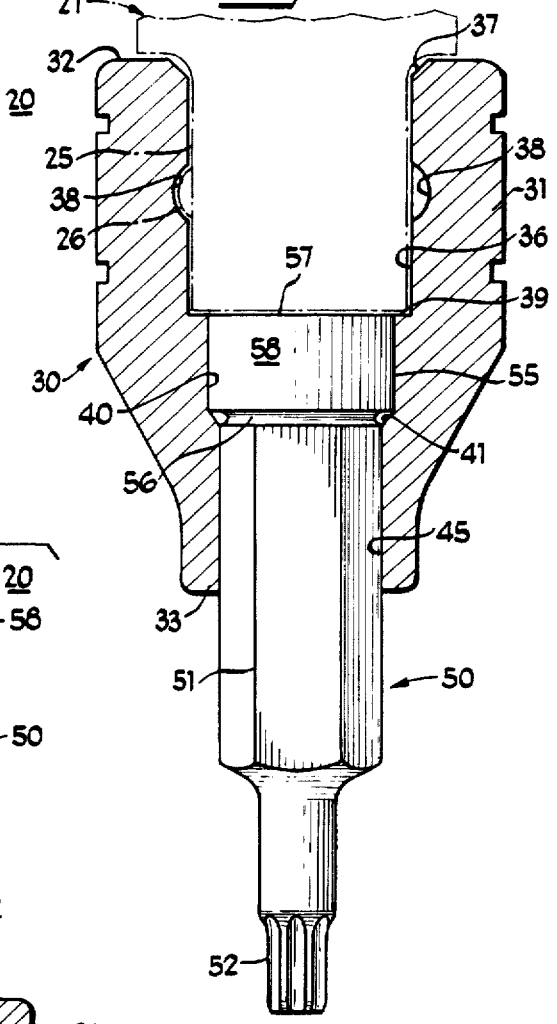
FIG. 5 is an enlarged view in vertical section of the socket of FIG. 4 with the bit of FIG. 4 engaged therein and illustrated in side elevation, and with an associated drive lug illustrated in phantom.

Referring to FIG. 5, there is illustrated a tool combination or assembly 20 constructed in accordance with and embodying the features of the present invention, and including a socket 30 and a bit 50. The socket 30 is adapted for use with an associated driving tool 21 having a drive lug 25 provided with a detent ball 26, in the same manner as was described above in connection with the socket 11.

Figure 2:
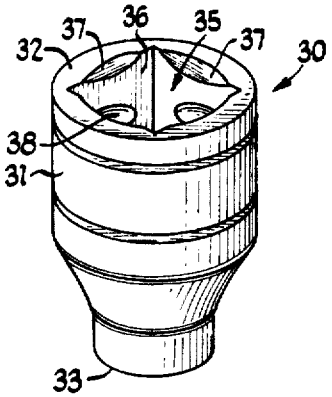
FIG. 2 is a perspective view of a socket constructed in accordance with and embodying the features of the present invention.
Figure 3:
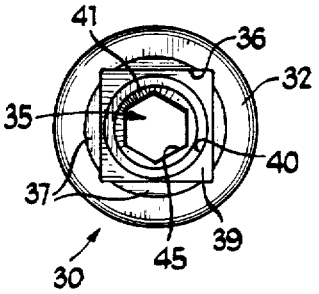
FIG. 3 is a top plan view of the socket of FIG. 2.
Figure 4:
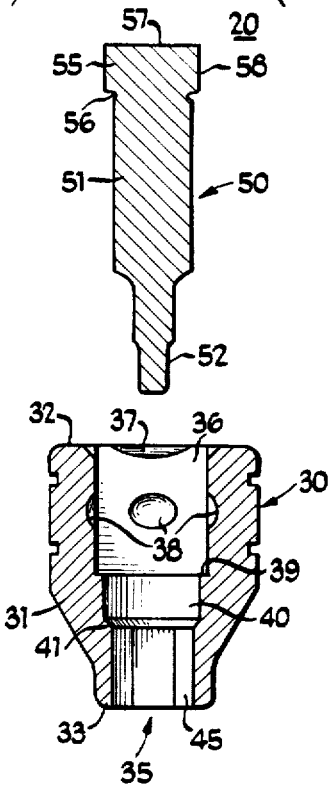
FIG. 4 is an exploded view in vertical section of the socket of FIG. 2 and an associated bit in accordance with the present invention.

Referring also to FIGS. 2–4, the socket 30 includes a generally cylindrical body 31 having a drive end 32 and a bit end 33. The socket body 31 has a hole 35 extending axially therethrough from the drive end 32 to the bit end 33 thereof. The hole 35 includes a drive portion 36 which extends axially inwardly from the drive end 32 and is substantially square in transverse cross section for receiving the square drive lug 25 of the associated driving tool 21. The driving portion 36 may be provided with beveled or tapered guide surfaces 37 at the entry end thereof to facilitate insertion of the drive lug 25, and may also be provided with detent recesses 38 for receiving the detent ball 26 of the drive lug 25 to retain the socket 30 on the drive lug 25, all in a known manner.

The drive portion 36 communicates at its inner end with a circularly cylindrical retaining portion 40 having a diameter less than the width of the drive portion 36, so that the bottom wall of the drive portion 36 defines a shoulder 39 which surrounds the retaining portion 40 and faces the drive end 32 of the socket 30. The other end of the retaining portion 40 is joined by a frustoconical shoulder 41 to a hexagonal bit portion 45, which extends to the bit end 33 of the socket 30. The bit portion 45 has a width which is less than the diameter of the retaining portion 40, so that the shoulder 41 converges toward the bit end 33 and faces the drive end 32 of the socket 30. While the bit portion 45 is illustrated as having a hexagonal shape, it will be appreciated that it could have other polygonal shapes.

Figure 6:
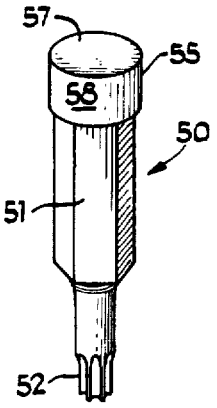
FIG. 6 is a perspective view of the bit of FIG. 4.

Referring in particular to FIGS. 4, 5 and 6, the bit 50, has an elongated shank 51, hexagonal in transverse cross section and dimensioned to be mateably received in the bit portion 45 of the socket hole 35 for driven engagement thereby, in a known manner. The shank 51 is provided at one end thereof with an application tip 52 which has a transverse width less than or equal to that of the shank 51 so as to be freely receivable through the bit portion 45 of the socket hole 35, and is provided at least at its distal end with a desired application configuration. In the illustrated embodiment, the application tip 52 has a fluted configuration, but it will be appreciated that any desired configuration, such as a screwdriver blade of any desired configuration, a hexagonal key, or the like may be used. The shank 51 is provided at its other end with an enlarged, circularly cylindrical head 55, which is joined to the shank 51 by a circumferential undercut or groove 56 which is generally part-circular in transverse cross section. The head 55 has a circular end surface 57 and a circularly cylindrical side surface 58 which has a diameter slightly greater than the width of the shank 51 and is dimensioned to be mateably received in the retaining portion 40 of the socket hole 35.

In operation, the bit 50 is dropped into the socket hole 35 from the drive end 32 of the socket 30. More specifically, the application tip 52 of the bit 50 is inserted into the drive portion 36 of the socket hole 35 and allowed to drop therethrough until it reaches a use position illustrated in FIG. 5, wherein the bit head 55 seats against the shoulder 41, with the shank 51 extending through the bit portion 45 and beyond the bit end 33 of the socket 30. Preferably, the head 55 of the bit 50 is so dimensioned that the end surface 57 thereof is substantially coplanar with the shoulder 39 when the head 55 is seated on the shoulder 41. It will be appreciated that when the drive lug 25 of the driving tool 21 is inserted in the drive portion 36 of the socket hole 35, it retains the bit 50 in place in the hole 35 and cooperates with the shoulder 41 substantially to inhibit axial movement of the bit 50. Thus, separate retaining members, such as roll pins or set screws are obviated.

Figure 7:
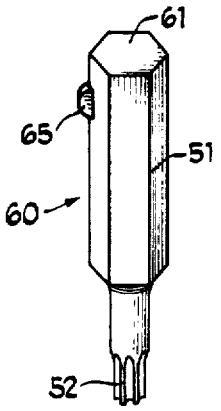
FIG. 7 is a view similar to FIG. 6 of a bit in accordance with another embodiment of the invention.

Referring to FIG. 7, there is illustrated an alternative form of bit 60, which is substantially similar to the bit 50, with like parts bearing the same reference numerals. However, the bit 60 is not provided with an enlarged head. Rather, the shank 51 has a hexagonal end surface 61 and is provided with one or more laterally outwardly projecting ears 65 (one shown) spaced axially from the end surface 61 a distance substantially equal to the axial extent of the retaining portion 40 of the socket hole 35. While one ear 65 is illustrated, preferably two are provided at diametrically opposed locations on the shank 51. The ears 65 are preferably at corners of the hexagonal shape, as illustrated, but could be located on the flats. Thus, it will be appreciated that the bit 60 is inserted in the socket hole 35 in the same manner as was described above with respect to the bit 50, until the ears 65 seat against the shoulder 41. It will be appreciated that the positioning of the ears 65 is such that, when thus seated, the end surface 61 of the bit 60 is substantially coplanar with the shoulder 39 of the socket hole 35.

Preferably, the bit shank 51 has a length such that, when the bit 50 or 60 is seated in its use position in the socket 30, the shank 51 projects well beyond the bit end 33 of the socket 30. In any event, the retaining portion of the bit 50 or 60, i.e., the inner end of the head 55 or the ears 65, are spaced from the adjacent end surface 57 or 61 of the bit 50 or 60 a distance substantially less than the distance they are spaced from the opposite end of the shank 51. Preferably, the latter distance is three to six times the former.

Referring now to FIGS. 8–14, there is illustrated a drive adapter, generally designated by the numeral 70, constructed in accordance with and embodying the features of the present invention, and including a socket 80 and a drive lug 90. The drive adapter is designed to transfer torque between male and female drive elements of different sizes. The drive adapter 70 is illustrated as being a square drive, but it will be appreciated that other polygonal shapes, such as hexagonal, could be used, if desired. The socket 70 is adapted for use with an associated driving tool having a male drive lug 71 provided with a detent ball 72, in a known manner (see FIGS. 10 and 11).

The socket 80 includes a generally cylindrical body 81 having a relatively large-diameter drive end 82 and a relatively small-diameter drive end 83. The socket body 81 has a hole 85 extending axially therethrough from the large drive end 82 to the small drive end 83. The hole 85 includes a large drive portion 86 which extends axially inwardly from the large drive end 82 and is substantially square in transverse cross section for receiving the square drive lug 71 of the associated driving tool in mating engagement therewith. The large drive portion 86 may be provided with beveled or tapered guide surfaces **86*a* at the entry end thereof to facilitate insertion of the drive lug 71. The large drive portion 86 of the hole 85 communicates at its inner end with a small drive portion 87 having a substantially square transverse cross section of a smaller area than that of the large drive portion 86, so that the bottom wall of the large drive portion 86 defines a shoulder 88 which surrounds the small drive portion 87 and faces the large drive end 82 of the socket 80. Each of the drive portions 86 and 87 is defined by four substantially planar side walls. The walls of the large drive portion 86 may, respectively, be provided with detent recesses 89 for receiving the detent ball 72 of the drive lug 71, while the walls of the small drive portion 87 may, respectively, be provided with small detent recesses 89*a* for a purpose to be described below (see FIGS. 10 and 11**).

The drive lug 90 is in the nature of an elongated bar substantially square in transverse cross section and dimensioned for mating engagement in the small drive portion 87 of the hole 85. The drive lug 90 has substantially parallel, flat square end surfaces 91 and 92, respectively at the opposite ends thereof, and four flat, rectangular side surfaces 93 joined by four corners 94, each of which may be slightly beveled or rounded. Two opposed ones of the corners 94 are upset crimped adjacent to the end surface 91 to define two laterally outwardly projecting retaining ears 95. Each of the retaining ears 95 has a short axial extent and is preferably formed at the end surface 91, but could be spaced a slight distance therefrom. Also, while the retaining ears 95 are preferably formed at the corners 94 for ease of manufacture, they could be formed along the side surfaces 93. One of the side surfaces 93 is provided with axially spaced-apart recesses in which are respectively received spring-loaded detent balls 97 and 98, in a known manner.

In operation, the drive lug 90 is dropped into the socket hole 85 from the large drive end 82 thereof. More specifically, the end surface 92 of the drive lug 90 is inserted into the large drive portion 86 of the hole 85 and allowed to drop therethrough and through the small drive portion 87 until it reaches a use position illustrated in FIGS. 8–11, wherein the retaining ears 95 seat against the shoulder 88, with the drive lug 90 extending through the small drive portion 87 of the hole 85 and beyond the small drive end 83 of the socket 80. In this use position, the detent ball 97 is disposed in engagement in one of the detent recesses **89*a* for facilitating retention of the drive lug 90 in the socket hole 85, while the detent ball 98 is disposed outwardly beyond the small drive end 83 of the socket 80 a predetermined distance for engagement in an associated detent recess in an associated female drive element (not shown). It will be appreciated that when the drive lug 71 of the associated driving tool is inserted in the large drive portion 86 of the hole 85, as illustrated in FIGS. 10 and 11, it retains the drive lug 90 in place in the hole 85 and cooperates with the shoulder 88 substantially to inhibit axial movement of the drive lug 90**.

It will be appreciated that the drive adapter 70 affords significant advantages over prior one-piece drive adapters. Because the socket 80 and the drive lug 90 are discrete, separable members, they may be formed of different materials and/or may be provided with different heat treatments so that the smaller cross-section drive lug 90 may be of higher strength than the larger diameter socket to minimize the chance of breakage of the smaller cross-section drive lug 90 in use. Furthermore, in the event that the drive lug 90 does break, it can be separately replaced at significantly lower cost than the cost of replacing an entire one-piece drive adapter.

From the foregoing, it can be seen that there have been provided improved combination tools which are of simple and economical construction and characterized by ease of use with a minimum number of parts. In particular, there has been provided an improved drive adapter of two-part construction so that the lug portion of the adapter is separable from the socket portion thereof to minimize incidence of breakage and reduce replacement costs in the event of breakage.

We claim:

1. A polygonal drive adapter for transmitting torque between polygonal male and female drive elements of different size comprising: a unitary one-piece socket member having first and second ends and a longitudinal hole therethrough from end-to-end, said hole having a first polygonal portion of a first size adjacent to said first end for receiving an associated male polygonal drive element in mating engagement therewith and a second polygonal portion adjacent to said second end having the same cross-sectional shape as said first portion but of a second size different from said first size, a shoulder in said hole between said first and second portions facing said first end, and an elongated polygonal drive lug having an application end receivable in said second portion of said hole in mating engagement therewith and adapted for mating engagement with an associated female drive element and a coupling end, said drive lug having a plurality of flat planar sides joined by a plurality of corner portions, said drive lug including laterally extending retaining projections respectively formed at spaced-apart corner portions of said drive lug adjacent to said coupling end, said application end of said drive lug being insertable in and removable from said hole from said first end thereof with said projections engageable with said shoulder to limit the depth of insertion at a working position wherein said application end of said drive lug projects outwardly beyond said second end of said socket member.

2. The drive adapter of claim 1, wherein each of said first and second portions of said hole is substantially square in transverse cross section.

3. The drive adapter of claim 1, wherein said first portion of said hole is larger than said second portion thereof.

4. The drive adapter of claim 1, wherein said second portion of said hole and said drive lug are substantially square in transverse cross section.

5. The drive adapter of claim 4, wherein said projections are respectively disposed at opposed corner portions of said drive lug.

6. The drive adapter of claim 1, wherein each of said projections comprises a crimped corner portion of said drive lug.

7. The drive adapter of claim 6, wherein said crimped corner portions are disposed at said coupling end of said drive lug.

8. The drive adapter of claim 1, wherein said socket member includes a plurality of flat wall portions cooperating to define said first portion of said hole, at least one of said flat wall portions having a first detent recess formed therein.

9. The drive adapter of claim 8, wherein said body includes a plurality of second flat wall portions cooperating to define said second portion of said hole, at least one of said second wall portions having a second detent recess formed therein.

10. The drive adapter of claim 9, wherein said drive lug includes two detent balls at longitudinally spaced-apart locations thereon, one of said detent balls being disposed for engagement in said second detent recess to assist in retaining said drive lug in said hole.

11. The drive adapter of claim 1, wherein said drive lug includes a detent ball projecting laterally therefrom to facilitate engagement with the associated female drive element.

12. The drive adapter of claim 1, wherein said projections comprise upset crimped corner portions of said drive lug.

* * * * *